US005290464A

United States Patent [19]

Fisicaro et al.

[11] Patent Number: 5,290,464

[45] Date of Patent: Mar. 1, 1994

[54] LUBRICANT COMPOSITIONS FOR AUTOTRACTION

[75] Inventors: Giuseppe Fisicaro, Rome; Giampaolo Gerbaz, Milan, both of Italy

[73] Assignee: Agip Petroli S.p.A., Rome, Italy

[21] Appl. No.: 16,682

[22] Filed: Feb. 11, 1993

Related U.S. Application Data

[63] Continuation of Ser. No. 778,520, Oct. 18, 1991, abandoned.

[30] Foreign Application Priority Data

Oct. 19, 1990 [IT] Italy ..... 21812 A/90

[51] Int. Cl.[5] ..... C10M 129/84

[52] U.S. Cl. ..... 252/52 R; 538/277

[58] Field of Search ..... 252/56 S, 52 R; 558/277

[56] References Cited

U.S. PATENT DOCUMENTS 2,739,127 3/1956 Morway et al. ..... 252/56 S 3,642,858 2/1972 Fevel et al. ..... 260/463

FOREIGN PATENT DOCUMENTS 0089709 9/1983 European Pat. Off. .

0154363 9/1985 European Pat. Off. .

*Primary Examiner*—Jacqueline V. Howard

*Attorney, Agent, or Firm*—Shea & Gould

[57] ABSTRACT

A lubricant composition comprises: a) a mineral base oil; b) a synthetic base oil; c) a long-chain dialkyl carbonate; d) a parcel of usual additives; and e) viscosity index and pour point improvement additives. Component c) is the product of transesterification of a lower dialkyl carbonate with an alcoholic mixture consisting of at least 98% by weight of aliphatic alcohols with a linear or essentially linear hydrocarbon chain carrying a —$CH_2$—OH group on a non-terminal carbon atom, the total number of carbon atoms in the molecule varying from 10 to 18 and preferably from 13 to 16.

19 Claims, No Drawings

LUBRICANT COMPOSITIONS FOR AUTOTRACTION

This is a continuation, of application Ser. No. 07/778,520 filed Oct. 18, 1991, now abandoned.

This invention relates to an improved lubricant composition for use in internal combustion engines.

It is known in the art to use synthetic bases in formulating lubricant compositions both of single grade and of multigrade type. In this respect, synthetic bases are able to eliminate or at least alleviate the drawbacks often encountered when using only mineral bases, these requiring 1) the presence of extremely fluid fractions to obtain the desired viscosity at low temperature and to limit volatility, 2) the presence of a high percentage of viscosity index improvers to improve the initial VI, and 3) other additives for satisfying all the other lubricant performance requirements.

For use in internal combustion engines, lubricant compositions must possess certain characteristics, namely thermal stability, oxidation resistance, low volatility and such viscosity-temperature characteristics as to allow both cold starting and good lubrication at maximum operating temperature.

Lubricant compositions which have been proposed for this purpose include those containing higher dialkyl carbonates in combination with a mineral oil and usual additives. These compositions, which are described for example in U.S. Pat. No. 2,387,999. U.S. Pat. No. 2,758,975, 3,642,858 and European patent application 89,709, result in various improvements compared with compositions based on carboxylic esters, in particular in relation to increased thermal, hydrolytic and oxidative stability.

A particular class of higher alkyl carbonates has now been found which results in a general rheological and engine performance improvement in the lubricant compositions in which they are incorporated, and thus make them desirable for use as high-performance lubricant compositions for four-stroke gasoline and diesel engines.

In accordance therewith the present invention provides a lubricant composition comprising:

a) from 0 to 90% by weight of a mineral base oil;
b) from 0 to 90% by weight of a synthetic base oil;
c) from 5 to 50% by weight of a long-chain dialkyl carbonate;
d) from 6 to 12% by weight of a parcel of usual additives; and
e) from 0 to 15% by weight of viscosity index and pour point improvement additives;

said composition being characterised in that the component c) is the product of transesterification of a lower dialkyl carbonate with an alcoholic mixture consisting of at least 98% by weight of aliphatic alcohols with a linear or essentially linear hydrocarbon chain carrying a —$CH_2$—OH group on a non-terminal carbon atom, the total number of carbon atoms in the alcohol varying from 10 to 18 and preferably from 13 to 16.

In the preferred embodiment, component a) is present in a quantity of between 0 and 60% by weight, component b) from 20 to 60% by weight, component c) from 15 to 30% by weight, component d) from 8 to 10% by weight and component e) from 5 to 10% by weight. Lubricant oils which can be used as component a) of the composition of the present invention are oils of mineral origin obtained by petroleum distillation followed by solvent and/or hydrogen refining generally having a viscosity index of 102–108, a pour point of between −12° C. and −6° C. and a Noack evaporation loss of 12–42%.

Synthetic base oils which can be used as component b) of the composition of the present invention are oils of synthetic origin and can be obtained by the polymerization of terminal or internal olefins followed by purification, or by isomerization and/or alkylation of petroleum fractions followed by purification. Alcohols which can be used for preparing component c) of the composition of the present invention are mixtures containing at least 98% and preferably at least 99% of aliphatic alcohols with a linear or essentially linear hydrocarbon chain carrying a —$CH_2$—OH group on a non-terminal carbon atom, the total number of carbon atoms in the alcohol varying from 10 to 18 and preferably from 13 to 16. More specifically, alcohols suitable for the purpose are alcohols definable by the formula:

$$CH_3-(CH_2)_m-\underset{\underset{CH_2-OH}{|}}{CH}-(CH_2)_n-CH_3 \qquad (I)$$

where m is a whole number and n is zero or a whole number, with the condition that the total number of carbon atoms in the molecule is between 10 and 18 and preferably between 13 and 16. Preferred mixtures are those in which the —$CH_2$—OH group is prevalently in position 2 of the chain.

Mixtures of alcohols (I) suitable for the purpose include the branched fraction of the oxo-alcohols obtained by hydroformylation, using carbon monoxide and hydrogen, of linear or essentially linear olefins with a statistical internal or terminal double bond, operating with cobalt or rhodium catalysts. This branched oxo-alcohol fraction can be separated from the linear fraction by fractional crystallization operating in the presence of a hydrocarbon or ether solvent, as described for example in U.S. Pat. No. 4,670,606. According to this patent, a mixture of linear and branched chain oxo-alcohols is dissolved in a liquid hydrocarbon solvent containing from 3 to 5 carbon atoms in the molecule, or in methyl tert-butyl ether. The solution is cooled to a temperature within the range of −20° C. to −52° C. to cause separation of a solid phase consisting of the linear oxo-alcohols, and a liquid phase consisting of a solution of the branched oxo-alcohols in the chosen solvent. The branched oxo-alcohols can generally be separated form this solution with a purity of the order of 95%, and be purified by further crystallization to obtain the mixture of alcohols (I) suitable for the purposes of the present invention, with a purity exceeding 98% and preferably exceeding 99%.

Such a mixture of alcohols (I) is then transesterified with a lower dialkyl carbonate to give component b) of the composition of the present invention. This reaction can be effected by bringing the reagents into contact in the presence of a basic catalyst operating at high temperature and under reduced pressure, and eliminating the lower aliphatic alcohol evolved as the reaction by-product, as is well known in the art and described in the examples given in European patent application publication No. 89,709. Preferred lower dialkyl carbonates are dimethyl carbonate and diethyl carbonate. Active transesterification catalysts useful for the purpose are sodium methylate and sodium ethylate. On termination of the transesterification reaction the long-chain dialkyl carbonate is recovered to constitute component b) of the composition of the present invention, its characteristics falling generally within the following value ranges (general and preferred):

| | |
|---|---|
| Average molecular weight: | 340–560 (preferred 420–510) |
| Viscosity 100° C. cSt (ASTM D455): | 3–12 (preferred 4–8) |
| Viscosity −30° C. cP (ASTM D2602): | 800–5000 |
| Viscosity index V.I. (ASTM D2270): | 120–140 |
| Pour point (°C.) (ASTM D97): | −60 to −30 |
| Flash point COC (°C.) (ASTM D92): | 220–350 |
| Noack volatility (%) (DIN 51581): | 15–2 |
| Copper corrosion (ASTM D130): | 1a–1b |
| TAN (mg KOH/g) (ASTM D 974): | 0.01–0.05 |

Such a dialkyl carbonate also has desirable characteristics in relation to low temperature rheology values, oxidation stability, elastomer compatibility, biodegradability and toxicity. Component d) of the composition of the present invention consists of a parcel of additives usually used in lubricants and specifically dispersants, antiwear and antitrust additives, metal passivators and copper deactivators, detergent additives (superbasic and neutral) and antioxidants. These additives are usually chosen from the following classes of compounds: alkyl/alkenyl succinimides, succinic esters; alkyl/aryl dithiophosphates of zinc and olefins; ethoxylates, esters and hemiesters of substituted succinic acids; unsaturated or carbonyl compounds of chelating action; heterocyclic compounds; metal salts (neutral and superbasic) of alkyl and aryl sulphonic acids, salicylic acids, phenols and substituted phenols; sterically hindered amines and phenols; sulphurated compounds.

Component e) of the composition of the present invention consists of a collection of additives able to raise the viscosity index and lower the pour point of the resultant lubricant composition. These additives are usually chosen from the following classes of compounds: olefinic copolymers, methacrylic copolymers, olefinic/methacrylic copolymers. Said additives can also have other properties such as antioxidant, dispersant and antiwear, together with the basic properties of viscosity index and pour point improvers.

Typical lubricant compositions suitable for four-stroke gasoline and diesel engines contain the aforesaid components in the following weight percentages:

| Composition | 1 | 2 | 3 | 4 | 5 | 6 |
|---|---|---|---|---|---|---|
| a) | 60 | 40 | 20 | 0 | 0 | 0 |
| b) | 10 | 20 | 30 | 40 | 42 | 44 |
| c) | 10 | 20 | 30 | 40 | 42 | 44 |
| d) | 10 | 10 | 10 | 10 | 8 | 6 |
| e) | 10 | 10 | 10 | 10 | 8 | 6 |

The long-chain dialkyl carbonate used as component c) in the lubricant compositions enables lubricant compositions for autotraction to be formulated possessing unexpectedly good overall rheological and engine performance characteristics. In this respect, the particular dialkyl carbonate structure enables a high viscosity index, a low pour point and a low volatility to be obtained simultaneously. In addition the high polarity of the carbonate group together with its structural characteristics enables high engine performance to be obtained together with a reduction in the level of addition of component d). In particular the high polarity results in good dispersing action towards engine sludge (enabling dispersants to be reduced by about 30% in the lubricant composition), the greasing of metal surfaces subject to wear (enabling antiwear additives to be reduced by about 20% in the lubricant composition), and an antirust and electrochemical protection action on ferrous and non-ferrous metal surfaces (enabling antirust additives, metal passivators and copper deactivators to be reduced by about 30%). The high thermal and oxidative stability of component c) enables the antioxidant additives to be reduced by about 30% in the lubricant composition, and the absence of acid compounds deriving from decomposition phenomena enables the superbasic detergent additives to be reduced by about 20%. Finally, component c) of the composition is practically inert towards the elastomers usually present in the lubrication circuit. As a result, lubricant compositions can be formulated with a medium-high nitrogen content, avoiding the addition of specific additives normally introduced to overcome the elastomer compatibility tests scheduled in the most severe specifications such as CCMC and VW specifications.

It should be noted that in the known art oxo-alcohols are described as alcohols suitable for preparing long-chain dialkyl carbonates for lubricant compositions, however without separation of the linear fraction from the branched fraction. According to the present invention the use of the mixture of alcohols (I) with the aforesaid characteristics is critical in order to obtain the required characteristics for the dialkyl carbonates and for the lubricant compositions which incorporate them, as will be apparent from the experimental examples which are given hereinafter to better illustrate the present invention.

EXAMPLE 1

A mixture of oxo-alcohols of the following characteristics is used:

| | |
|---|---|
| number of carbon atoms | 13–16 |
| average molecular weight | 220 |
| linear fraction | 40% |
| branched fraction | 60% |

This oxo-alcohol mixture is the product of the hydroformylation of substantially linear olefins with carbon monoxide and hydrogen in the presence of a catalyst.

The mixture is subjected to fractional crystallization at low temperature in the presence of a hydrocarbon solvent as described in U.S. Pat. No. 4,670,606, to separate a solid linear alcohol fraction from a liquid fraction containing 95% by weight of branched alcohols. This liquid fraction is purified by a second fractional crystallization similar to the first, to separate a liquid fraction with a branched alcohol content exceeding 99% by weight.

In this manner a mixture of alcohols of formula (I) is obtained having the following distribution:

| | |
|---|---|
| $C_{13}$ alcohol content | 6% by weight |
| $C_{14}$ alcohol content | 48% by weight |
| $C_{15}$ alcohol content | 42% by weight |
| $C_{16}$ alcohol content | 4% by weight |

EXAMPLE 2

The mixture of branched alcohols (I) obtained in Example 1 is transesterified with dimethyl carbonate operating with sodium ethylate as catalyst, as described in European patent application No. 89,709, to obtain a dialkyl carbonate (I) with an average molecular weight of 470 and having the following characteristics:

| | |
|---|---|
| Viscosity 100° C. cSt | 4.16 |
| Viscosity −30° C. cP | 1600 |
| Viscosity index V.I. | 125 |
| Pour point (°C.) | −40 |
| COC Flash point (°C.) | 240 |
| Noack volatility (%) | 13 |
| Copper corrosion | 1a |
| TAN (mg KOH/g) | 0.05 |

EXAMPLE 3

For comparison purposes the linear and branched oxo-alcohol mixture obtained in the hydroformylation reaction is transesterified (without previous separation) with dimethyl carbonate using sodium ethylate as catalyst in accordance with Example 2, to obtain a dialkyl carbonate (II) with an average molecular weight of 470, a viscosity index of 130, a pour point of +12° C. and a Noack volatility of 15%.

EXAMPLE 4

The lubricant composition (A) of the present invention and the comparison lubricant composition (B) are prepared in accordance with the following Table I.

TABLE I

| Composition | (A) | (B) |
|---|---|---|
| mineral base oil | 43 | 43 |
| synthetic base oil | 10 | 10 |
| dialkyl carbonate (I) | 30 | — |
| dialkyl carbonate (II) | — | 30 |
| additives parcel | 8 | 8 |
| viscosity index and pour point improvement additives | 9 | 9 |

The compositions (A) and (B) are subjected to a series of rheological and laboratory tests aimed at evaluating the extent to which they satisfy the requirements of the European Sequence scheduled by constructors for CCMC oil classification and the requirements of the American sequence scheduled by constructors for API oil classification. The results are given in the following Table II.

TABLE II

Rheological and laboratory evaluation

| Characteristics | Comp. (A) | Comp. (B) | Limits* |
|---|---|---|---|
| viscosity at 100° C. (cSt) | 13.5 | 13.7 | 12.5–16.3 |
| viscosity at −25° C. (cPs) | 3450 | >6000 | 3500 max |
| BPT (°C.) | −39 | −15 | −30 max |
| stable pour point (°C.) | −42 | −18 | −35 max |
| HTS viscosity at 150° C. $10^6$ $sec^{-1}$ (cps) | 3.6 | 3.6 | 3.5 min |
| Noack volatility (%) | 12 | 14 | 13 max |
| elastomer compatibility | yes | yes | |
| foaming | no | no | |

*specification API and CCMC limits for 5W/40 grading.

From the aforegoing data it can be seen that the lubricant composition (A) in accordance with the present invention satisfies all the requirements of the American API and European CCMC Sequences. In contrast, the comparison lubricant composition (B) does not satisfy the requirements of viscosity at −25° C., BPT, stable pour point or Noack volatility. This behaviour is related to the different physico-chemical characteristics of the dialkyl carbonates (I) and (II) used in the compositions.

With regard to the engine tests scheduled by the same American API and European CCMC sequences, both the lubricant compositions satisfy all tests by a wide margin on the set limits. However only by using the dialkyl carbonates (I) of the present invention are lubricant compositions obtained which have optimum performance characteristics from both the engine and rheological aspects.

We claim:

1. A lubricant comprising:
   a) from 0 to 90% by weight of a mineral base oil;
   b) from 0 to 90% by weight of a synthetic base oil;
   c) from 5 to 50% by weight of a long-chain dialkyl carbonate;
   d) from 6 to 12% by weight of usual additives; and
   e) from 0 to 15% by weight of additives which raise the viscosity index and lower the pour point of the lubricant;

wherein the long-chain dialkyl carbonate is the transesterification product of a lower dialkyl carbonate with an alcoholic mixture consisting of at least 98% by weight of branched aliphatic alcohols having the formula:

$$CH_3-(CH_2)_m-\underset{\underset{CH_2-OH}{|}}{CH}-(CH_2)_n-CH_3, \quad (I)$$

where m is a whole number and n is zero or a whole number and where the total number of carbon atoms in the alcohol is 13 to 16.

2. The lubricant of claim 1, wherein the mineral base oil is between 0 and 60%, the synthetic base oil is from 20 to 60%, the long-chain dialkyl carbonate is from 15 to 30%, the usual additives are from 8 to 10%, and the viscosity index and pour point additives are from 5 to 10% and wherein the lubricant is suitable for four-stroke gasoline and diesel engines.

3. The lubricant of claim 1, wherein the mineral base oil is a lubricating oil obtained by petroleum distillation followed by refining and has a viscosity index of 102–108, a pour point of between −12° C. and −6° C. and a Noack evaporation loss of 12–42%.

4. The lubricant of claim 1, wherein the synthetic base oil is the product of the polymerization of terminal or internal olefins or of the isomerization and/or alkylation of petroleum fractions.

5. The lubricant of claim 1, wherein the long-chain dialkyl carbonate is the transesterification product of the lower dialkyl carbonate with the mixture containing at least 99% of the branched aliphatic alcohols.

6. The lubricant of claim 5, wherein the branched aliphatic alcohols are the branched fraction of the oxoalcohols obtained by hydroformylating linear or essentially linear olefins using carbon monoxide, hydrogen, and a cobalt or rhodium catalyst, and separating the branched fraction from the linear fraction by fractional crystallization in the presence of a hydrocarbon or ether solvent.

7. The lubricant of claim 1, wherein the long-chain dialkyl carbonate has an average molecular weight of 340–560; a viscosity at 100° C. in cSt (ASTM D455) of 3-12; a viscosity at −30° C. cP (ASTM D2602) of 800-5000; a viscosity index V.I (ASTM D 2270) of 120-140; a pour point (°C.) (ASTM D97) of −60 to −30; a flash point COC (°C.) (ASTM D92) of 220-350; A Noack volatility (%) (DIN 51581) of 12-2; a copper corrosion (ASTM D130) of 1a-1b; and a TAN (mg KOH/g) (ASTM D974) of 0.01-0.05.

8. The lubricant of claim 1, wherein the usual additives consist of dispersant, antiwear and antirust additives, metal passivators, copper deactivators, superbasic and neutral detergents, and antioxidants.

9. The lubricant of claim 8, wherein the long-chain dialkyl carbonate has an average molecular weight of from 420 to 510 and a viscosity at 100° C. in cSt (ASTM D 455) of from 4 to 8.

10. The lubricant of claim 1, wherein the alcoholic mixture consists of at least 99% by weight of the branched aliphatic alcohols.

11. The lubricant of claim 10, wherein the alcoholic mixture is 6% by weight of a $C_{13}$ alcohol, 48% by weight of a $C_{14}$ alcohol, 42% by weight of a $C_{15}$ alcohol, and 4% by weight of a $C_{16}$ alcohol.

12. The lubricant of claim 1, wherein the additives consist of dispersant, antiwear and antirust additives, metal passivators, copper deactivators, superbasic and neutral detergents and antioxidants.

13. The lubricant of claim 1, wherein the alcoholic mixture consists of at least 99% by weight of the branched aliphatic alcohols.

14. A lubricant comprising:

a) 43% by weight of a mineral oil base;

b) 10% by weight of a synthetic base oil;

c) 30% by weight of a long-chain dialkyl carbonate which is the transesterification product of a lower dialkyl carbonate with an alcoholic mixture consisting of at least 98% by weight of branched aliphatic alcohols having the formula:

$$CH_3-(CH_2)_m-\underset{\underset{CH_2-OH}{|}}{CH}-(CH_2)_m-CH_3 \quad (I)$$

where m is a whole number and n is zero or a whole number and where the total number of carbon atoms in the alcohol is from 13 to 16;

d) 9% by weight of usual additives; and e) 8% by weight of additives which are able to raise the viscosity index and lower the pour point of the lubricant.

15. The lubricant of claim 14, wherein the mineral base oil is a lubricating oil obtained by petroleum distillation followed by refining and has a viscosity index of 102-108, a pour point of between −12° C. and −6° C. and a Noack evaporation loss of 12-42%.

16. The lubricant of claim 14, wherein the synthetic base oil is the product of the polymerization of terminal or internal olefins or of the isomerization and/or alkylation of petroleum fractions.

17. The lubricant of claim 14, wherein the branched aliphatic alcohols are the branched fraction of the oxoalcohols obtained by hydroformylating linear or essentially linear olefins with an internal or terminal double bond using carbon monoxide and hydrogen, and cobalt or rhodium catalysts, and then separating the branched fraction from the linear fraction by fractional crystallization in the presence of a hydrocarbon or ether solvent.

18. The lubricant of claim 14, wherein the long-chain dialkyl carbonate has an average molecular weight of 340-560; a viscosity at 100° C. cSt (ASTM D455) of 3-12; a viscosity at −30° C. cP (ASTM D2602) of 800-5000; a pour point (°C.) (ASTM D97) of −60 to −30; a flash point COC (°C.) (ASTM D92) of 220-350; a Noack volatility (%) (DIN 51581) of 12-2; a copper corrosion (ASTM D130) of 1a-1b; and a TAN (mg KOH/g) (ASTM D974) of 0.01-0.05.

19. The lubricant of claim 18, wherein the average molecular weight is 470; the viscosity at 100° C. cSt is 4.16; the viscosity at −30° C. cP is 1600; the viscosity index is 125; the pour point (0° C.) is −40; the COC flash point (0° C.) is 240; the Noack volatility (%) is 13; the copper corrosion is 1a; and the TAN (mg KOH/g) is 0.05.

* * * * *